US006418657B1

(12) United States Patent
Brown

(10) Patent No.: US 6,418,657 B1
(45) Date of Patent: Jul. 16, 2002

(54) SIGHT MOUNT FOR A FIREARM

(76) Inventor: Mark D. Brown, 945 San Ildefonso Rd., Los Alamos, NM (US) 87544

( * ) Notice: Subject to any disclaimer, the term of this patent is extended or adjusted under 35 U.S.C. 154(b) by 0 days.

(21) Appl. No.: 09/431,306

(22) Filed: Oct. 30, 1999

(51) Int. Cl.[7] ..... F41G 1/46
(52) U.S. Cl. ..... 42/124; 42/126
(58) Field of Search ..... 33/233; 42/112, 42/124, 127, 126, 125, 136

(56) References Cited

U.S. PATENT DOCUMENTS 3,820,248 A * 6/1974 Hayward ..... 33/241
4,208,821 A * 6/1980 Power ..... 42/1
4,651,432 A * 3/1987 Borancini ..... 42/133
4,660,289 A * 4/1987 Wilhide ..... 33/247
4,691,442 A * 9/1987 Center ..... 33/253
4,878,308 A * 11/1989 Rose ..... 42/102
RE33,485 E * 12/1990 Frimer ..... 362/84
5,595,011 A * 1/1997 Gorslin ..... 42/101
5,941,489 A * 8/1999 Fanelli et al. ..... 248/298.1

* cited by examiner

*Primary Examiner*—Michael J. Carone
*Assistant Examiner*—Denise J Buckley

(57) ABSTRACT

A sight mount for a firearm includes a base, a pair of upwardly extending protective ears, and a rearwardly extending platform for supporting an iron sight assembly. The base includes dovetail rails for securing the base to a firearm, and transverse slots for accepting an electronic sight. The protective ears serve to protect the iron sight assembly, particularly when the electronic sight is removed, and also serve to stabilize the iron sight assembly. The sight mount enables a user to either use the electronic sight alone, or the iron sights, by simply shifting the direction of the user's view into the sight. Alternately, the electronic sight may be removed and the iron sights used directly, without requiring any adjustment of the iron sights.

5 Claims, 6 Drawing Sheets

SIGHT MOUNT FOR A FIREARM

BACKGROUND OF THE INVENTION

1. Field of the Invention

The present invention relates to telescopic scopes and electronic sights for firearms. More particularly, the present invention relates to devices for mounting optical sights on rifles and other firearms.

2. Description of Related Art Including Information Disclosed Under 37 CFR 1.97 and 1.98.

Certain rifles, for example the military style rifles commonly known and sold as AR-15 or M-16 rifles, are produced in different models. Some models have fixed iron sights. Other models, known as "flat top" models, are not provided with fixed iron sights, as they are intended instead to accommodate a telescopic scope or an electronic sight of the kind commonly known as a "red dot" sight.

The flat top models typically include a mounting configuration which is manufactured to military specifications, and which consists of a series of transverse slots formed in a planar upper surface of the rifle receiver. The slots allow for a scope or electronic sight to be mounted on the rifle at various positions along the axis of the rifle, so as allow for appropriate setting of relief distance between the objective lens of the scope and the eye of the user. Alternately, a carry handle having an iron sight assembly may be affixed to the flat top of the rifle. Such rifles typically include a front site post for the latter purpose.

Scopes and optical sights are sometimes mounted directly on the rifle. In such a configuration it is typically not possible to also accommodate an iron sight on the rifle. In some situations a scope or optical sight is mounted on a carrying handle of a military style AR-15 or M-16 rifle, but such mountings are not considered the most desirable because they result in the scope or sight being raised considerably above the barrel of the rifle.

In other configurations the scope or optical sight is affixed to a separate mount, which is in turn affixed to the rifle. Such a configuration allows the scope or sight to be removed independently of the mount. One advantage of such a configuration is that the mount may be equipped with an iron sight, which may be used when the optical sight is removed from the rifle.

Previously known sight mounts have utilized an iron sight on a tiltable hinge, which allows the iron sight to be swung down and out of the way of the optical sight. When the optical sight is removed, the iron sight is swung upwardly into its ordinary position for use. The disadvantage of such a configuration is that the hinge introduces some inaccuracy into the iron sight. In addition the hinged iron sight, when raised, is exposed in an unprotected position and is thus subject to damage and inaccuracies caused by inadvertent physical impacts.

Accordingly, it is the object and purpose of the present invention to provide an improved sight mount for a firearm.

In particular, it an object and purpose of the present invention to provide a sight mount which includes an integral iron sight that can be used either when the optical sight is removed or with the optical sight mounted.

It is yet another object of the present invention to provide a sight mount that includes an integral iron sight which can be used either alone, with the optical sight removed, or in combination with an electronic sight.

More particularly, it is an object and purpose of the present invention to provide a sight mount having an integral iron sight that does not interfere with use of the optical sight alone, but which can alternately be used in combination with the electronic sight, either in its operational mode or in the event of battery or electronic failure of the sight.

These and other objects and purposes are attained in the present invention, as described below and defined in the appended claims.

BRIEF SUMMARY OF THE INVENTION

The present invention provides a sight mount for a firearm which includes a base having a forward end and a rear end. The base includes an upper surface having a plurality of transverse slots formed therein and a lower surface having a pair of inwardly directed V-shaped dovetail rails formed therein. The sight mount further includes an integral rear sight platform extending rearwardly from the rear end of the base, and a pair of integral protective ears extending upwardly from the rear end of the base.

In the preferred embodiment the rear sight platform includes a vertical bore and an intersecting transverse rectangular bore for receiving a vertical threaded shaft and an elevation adjustment knob, respectively, of an iron sight assembly. The base preferably further includes a concavely curved protective ramp which is integrally formed between the protective ears and which extends upwardly from the rearmost of the transverse slots.

These and other features and advantages of the present invention will be apparent from the more detailed description below, when taken with the accompanying drawings and appended claims.

BRIEF DESCRIPTION OF THE SEVERAL VIEWS OF THE DRAWING(S)

The accompanying drawings are incorporated into and form a part of this specification. In the drawings.

DETAILED DESCRIPTION OF THE INVENTION

Figure 1:
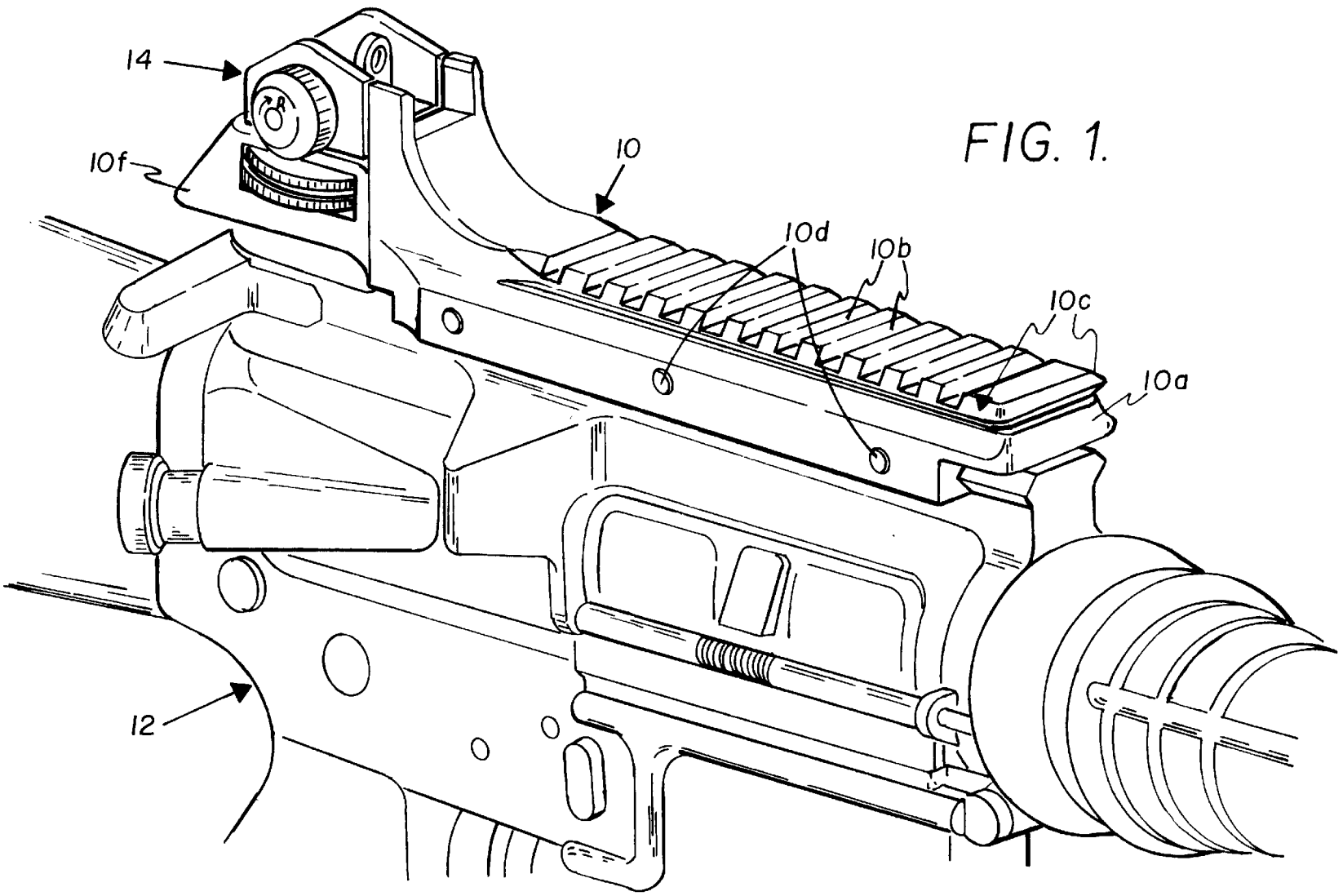
FIG. 1 is an isometric view of a preferred embodiment of the present invention as it is mounted on a conventional AR-15 or M-16 rifle.
Figure 2:
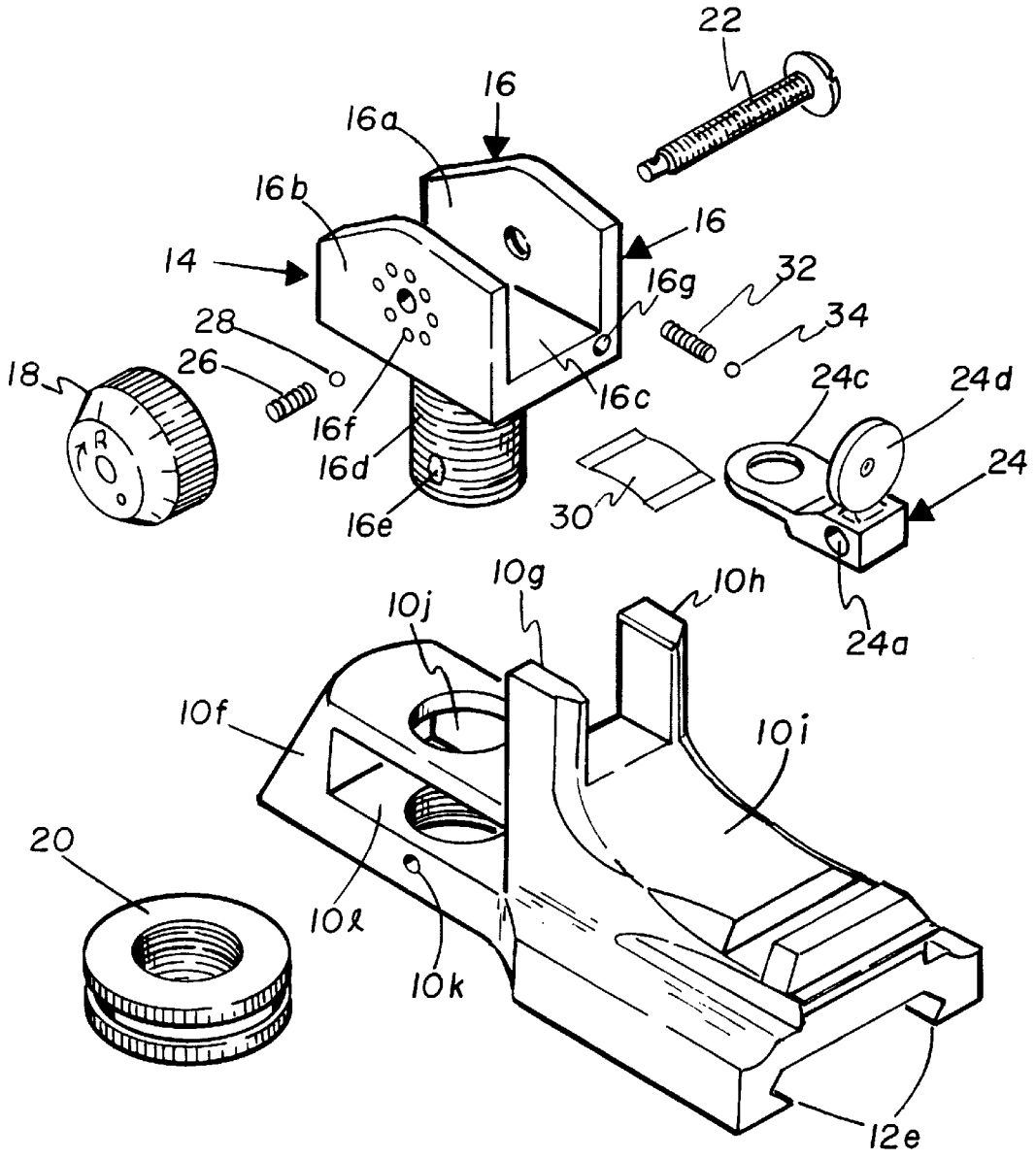
FIG. 2 is an isometric exploded view, in partial cross section, of the mount shown in FIG. 1.

Referring to the Figures, there is illustrated in FIGS. 1 and 2 a preferred embodiment of a sight mount 10 constructed in accordance with the present invention and mounted on a military style AR-15 or M-16 rifle 12.

Figure 3:
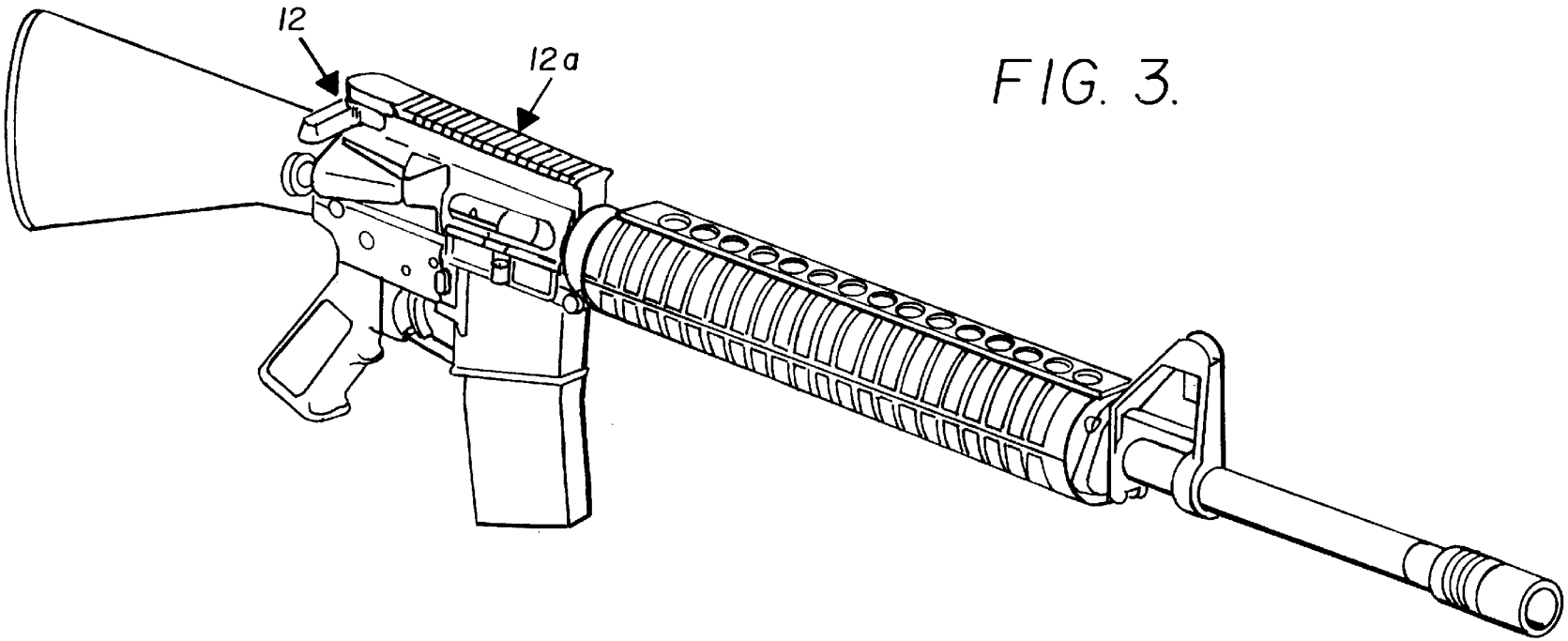
FIG. 3 is an isometric view of a conventional AR-15 or M-16 rifle having a flat top, military specification sight base.
Figure 4:
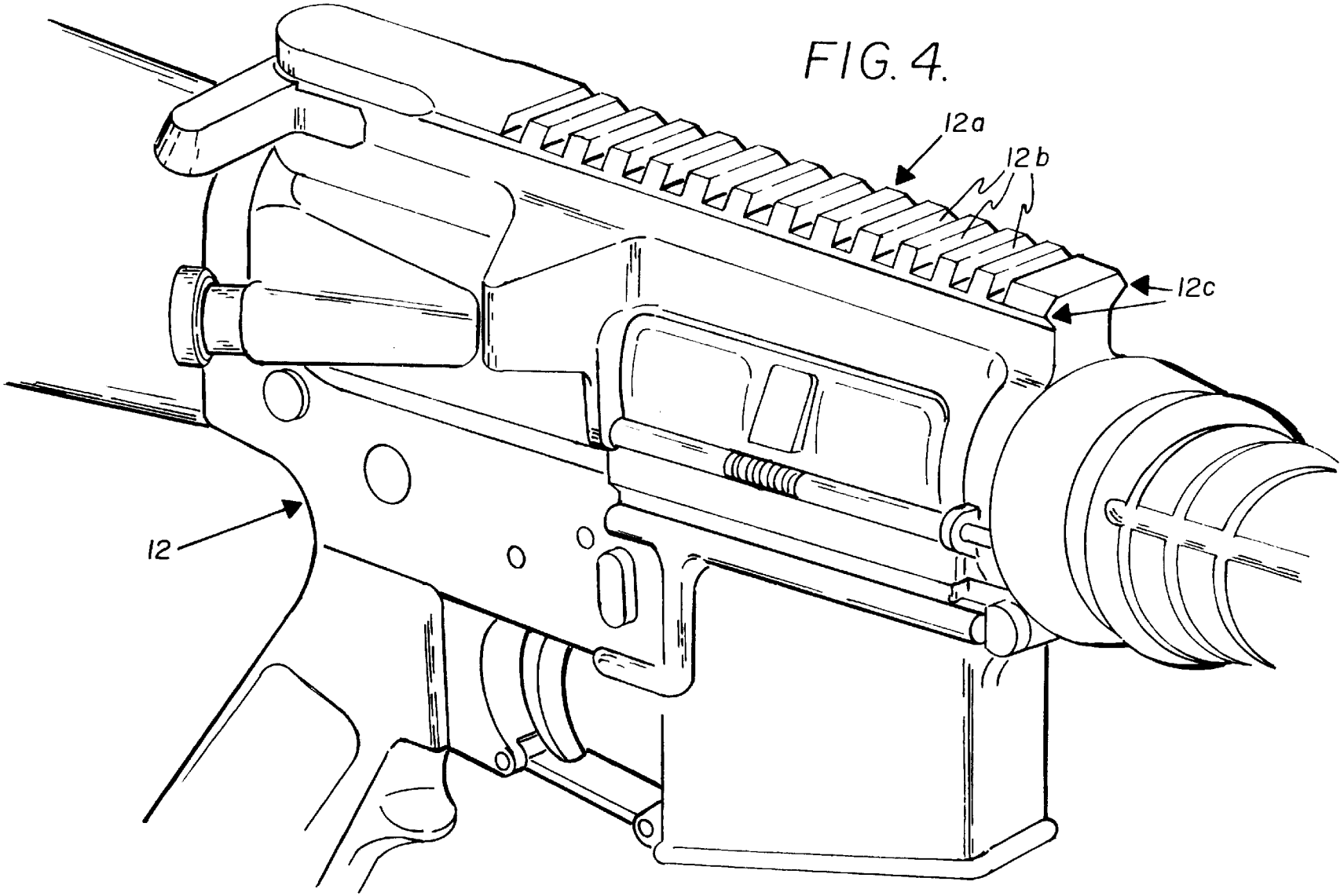
FIG. 4 is an enlarged view of the sight base on the rifle shown in FIG. 3.

The rifle 12 alone is illustrated in FIG. 3, and includes a flat-top type sight base 12*a* which is typically manufactured to military specifications. The sight base 12*a* includes spaced transverse slots 12*b*, and V-shaped longitudinal side rails 12*c* which constitute what is commonly referred to as a dovetail mount. The spaced slots 12 permit a scope or other mounting device to be mounted on the sight base 12*a* at various positions along the longitudinal length of the base 12*a*, so as to permit appropriate adjustment of the scope for purposes of focusing and also for purposes of providing appropriate eye relief between the scope and the eye of the user.

Referring to FIGS. 1 and 2, the sight mount 10 includes a generally rectangular base 10*a* having transverse spaced slots 10*b* on its upper surface, and V-shaped dovetail side rails 10*c* along the upper side edges of the base 10*a*, which together form a sight base which is much the same as that of the rifle 12. The sight mount 10 further includes three transverse threaded bores 10*d*, through which bolts (not shown) are passed through the transverse slots 12*b* of the rifle sight base. The bolts serve to locate the sight mount 10 on the sight base 12*a* and secure the sight mount 10 against longitudinal displacement caused by recoil of the rifle. The bolts also serve to clamp the sight mount 10 to the V-shaped rails 12*c* of the sight base 12*a*. In this latter regard, the sight mount 10 includes inwardly directed V-shaped rails 12*e* (FIG. 2), which engage with the V-shaped rails of the sight base 12*a*.

Referring particularly to FIG. 2, the sight mount 10 further includes an integral rear sight platform 10*f* which extends horizontally from the rear of the base 10*a*, and a pair of upwardly extending integral protective ears 10*g* and 10*h*, the function of which is described below. Protective ears 10*g* and 10*h* are connected by an integral, concavely curved ramp 10*i*, which curves upwardly from the rearmost one of the transverse slots 10*b* to approximately half the height of ears 10*g* and 10*h*. The sight platform 10*f* further includes a vertical bore 10*j* and an intersecting, transverse rectangular bore 10*l*.

The sight platform 10*f* supports a rear iron sight assembly 14 (FIG. 2). Sight assembly 14 includes a sight fixture 16 having spaced left and right sidewalls 16*a* and 16*b*, a horizontal floor 16*c*, and a vertical threaded shaft 16*d*. The sight assembly 14 further includes a windage knob 18 and an elevation knob 20. Windage knob 18 is secured to the outside surface of the right sidewall 16*b* by means of a threaded screw 22 and a roll pin (not shown). The screw 22 passes through both sidewalls 16*a* and 16*b* from the outside of left sidewall 16*a* and also passes through a threaded bore 24*a* formed in a dual aperture iron sight 24 which is positioned between the sidewalls 16*a* and 16*b*. A helical spring 26 and a ball bearing 28 are located in a bore (not shown) in the face of windage knob 18. The ball bearing 28 is urged by spring 26 against detents 16*e* which are formed in a circular array in the outside surface of right sidewall 16*b*. With this arrangement the windage knob 18 provides incremental adjustment of the position of the iron sight 24.

The threaded shaft 16*d* of the sight assembly passes through the bore 10*j* of the platform 10*f* and is retained in place by a roll pin (not shown) which passes through a small bore 10*k* in the side of platform 10*f* and through a vertical slot 16*e* in the shaft 16*d*. Elevation knob 20 is engaged with the threaded shaft 16*d* and positioned in the rectangular bore 10*l*. Elevation knob 20 includes an interior guide ring and ball-and-detent stops (not shown) which allow the elevation knob 20 to raise and lower the sight assembly 16 in discrete increments.

The iron sight 24 includes a long range aperture 24*b* and a short range aperture 24*c*. The sight 24 is rotatable about the screw 22. A flat spring 30, which is set into a rectangular recess (not shown) in the surface of floor 16*d*, functions to maintain the iron sight 24 with either the long range aperture 24*d* or the short range aperture 24*c* in the upright position.

The sight assembly 14 further includes a helical spring 32 and a ball bearing 34, which are set into a bore 16*g* that extends horizontally and longitudinally into the floor 16*c* where floor 16*c* intersects with left sidewall 16*a*. The function of helical spring 32 and ball bearing 34 is to urge the sight assembly 16 against the rear of left protective ear 10*h*, and thereby maintain optimum accuracy of the sight assembly 16. In this regard, it will be seen that the elevation knob 20 and the threaded shaft 16*d* operate to raise and lower the assembly 16, but do not precisely locate the assembly against small lateral displacements. The ball 34 and spring 32 serve to so locate the assembly against such lateral displacements.

Figure 5:
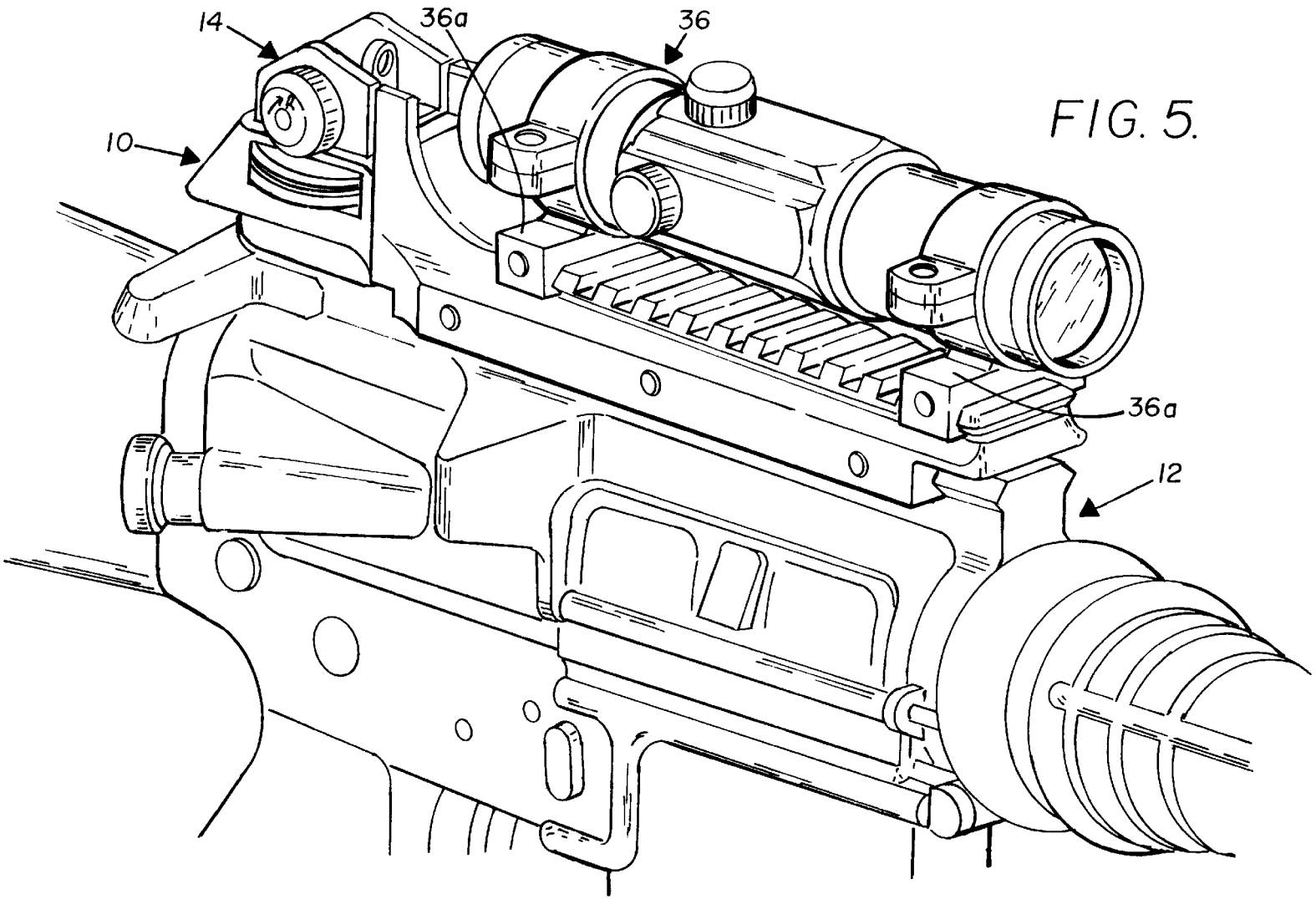
FIG. 5 is an isometric view of the rifle of FIG. 3, together with the sight mount of the present invention and an electronic sight mounted on the sight mount.
Figure 7:
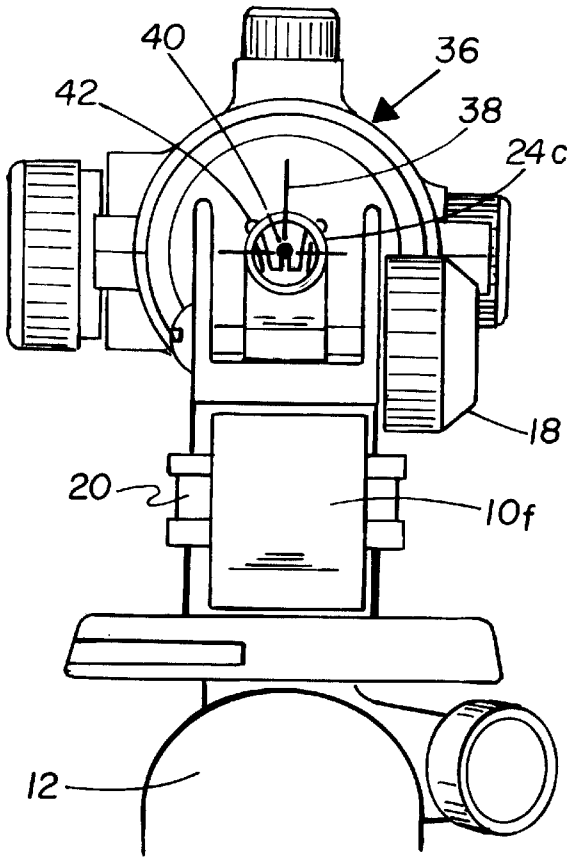
FIG. 7 is a rear view as in FIG. 6, but viewed with the iron sights aligned with the center aiming dot of the electronic sight.
Figure 6:
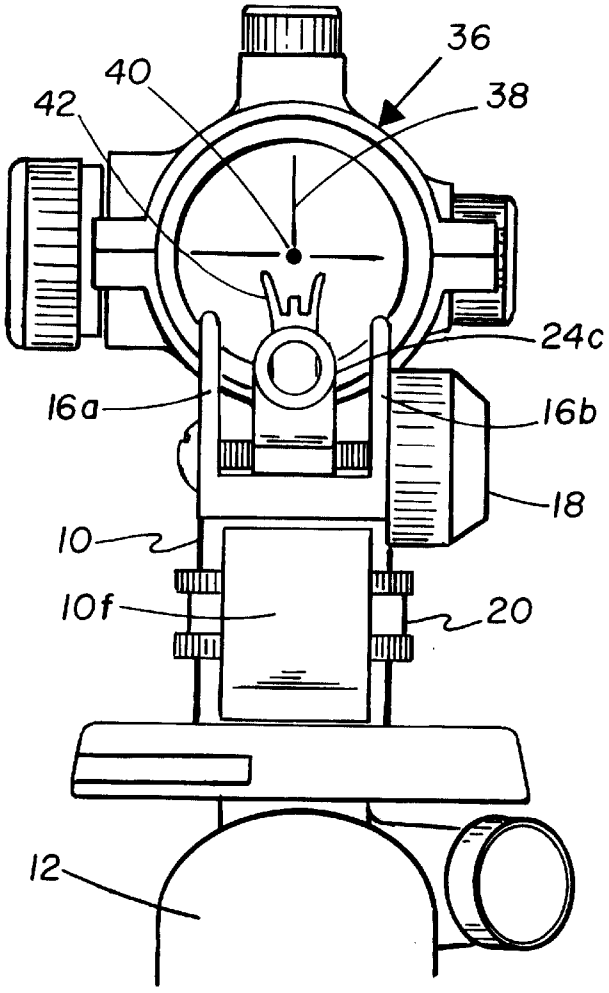
FIG. 6 is a rear view of the sight and sight mount of FIG. 5, as viewed from an raised position looking over the iron sight ring.

FIGS. 5 through 7 illustrate the sight mount 10 the present invention as it is used support a conventional electronic optical sight 36. It will be seen that the sight 36 includes dovetail mounts 36*a* which allow it to be secured to the sight mount 10 in the manner described above.

In particular, FIGS. 6 and 7 illustrate a principal advantage of the present invention. In FIGS. 6 and 7, a desired target is indicated by crossed lines 38 which are shown in the view of the sight 36. That is, it should be understood that the crossed lines 38 represent a desired target as seen through the sight 36, and are not crosshairs as are typically seen through a conventional telescopic sight. The actual aimpoint of the properly sighted rifle and sight 36 is illustrated by an aimpoint 40, which is shown centered on the target represented by the crossed lines 38 and which is typically presented as a red, electronically generated "red dot" in the view of the sight 36. It should also be understood, in connection with the further description below, that one of the features of modern electronic sights is that the aimpoint 40 remains accurately located on the target even though the user's angle of vision into the sight 36 may vary somewhat.

Thus, FIGS. 6 and 7 represent the view as seen by a user from two different angles. FIG. 6 represents the view as seen when the user is looking over the short range iron sight aperture 24*c* and also over a front sight post 42 of the rifle 12. That is, the user is viewing the sight from a slightly elevated position behind the sight 36.

In FIG. 7, the user is viewing the target from a lower angle, and is aligning the iron sight aperture 24 and the front sight post 42 on the target 38, and which results in the aimpoint 40 of the sight 36 also being centered on the target 38.

It will be seen that in both views represented by FIGS. 6 and 7, aimpoint 40 of the electronic sight is centered on the target 38.

Thus, the user can use the sight mount 10 of the present invention in two alternate modes. In FIG. 6 the user is aiming at target 38 using only the aimpoint 40 of the electronic sight 36, without using the iron sights. This is more appropriate, for example, in combat situations requiring quick sighting of the rifle. In FIG. 7, the user is using the iron sights together with the electronic sight to target the rifle. This mode might be used where increased accuracy is being sought, and where speed is not important. More importantly, however, this latter mode would be used where the electronic sight 36 has become nonfunctional, as for example where battery failure or other electronic failure has resulted in the aimpoint of the electronic sight no longer being visible. In such an event the iron sights can be used alone, sighting through the optical lenses of the nonfunctioning electronic sight, without first having to remove the electronic sight.

It will also be recognized that the electronic sight 36 can also be readily removed from the rifle to permit the iron sights to be used alone in their conventional manner. In such a mode it will be noted that the iron sight assembly 14 is protected from impacts and other abuses by the protective ears 10*g* and 10*h*, and also by the curved ramp 10 which serves to protected against snagging of the rifle in brush or other foreign objects.

The foregoing description of one or more preferred embodiments of the present invention is presented for purposes of illustration and explanation, and is not intended to be exhaustive or to limit the invention to the precise form disclosed. Various modifications, alterations, and substitutions may be possible in light of the foregoing description. Accordingly, it is intended that the scope of the invention be defined by the following claims.

What is claimed is:

1. A sight mount for a firearm, comprising:

a base having a forward end and a rear end, said base having an upper surface having a plurality of transverse slots formed therein and a lower surface having a pair of inwardly directed V-shaped dovetail rails formed therein;

an integral rear sight platform extending rearwardly from said rear end of said base, said platform including a vertical bore and an intersecting transverse rectangular bore for receiving a vertical threaded shaft and an elevation adjustment knob, respectively, of an iron sight assembly, and wherein said platform and said vertical bore and said intersecting transverse rectangular bore are positioned to enable use of said iron sight assembly while viewing a target through a sight mounted on the sight mount; and a pair of integral protective ears extending upwardly from said rear end of said base.

2. The sight mount defined in claim 1, wherein said base further includes a concavely curved protective ramp which is integrally formed between said protective ears and which extends upwardly from the rearmost one of said plurality of transverse slots.

3. A sight mount for a firearm, comprising in combination:

a base having a forward end and a rear end, said base having an upper surface having a plurality of transverse slots formed therein and a lower surface having a pair of inwardly directed V-shaped dovetail rails formed therein;

an integral rear sight platform extending rearwardly from said rear end of said base;

a pair of integral protective ears extending upwardly from said rear end of said base; and an iron sight assembly mounted on said rear sight platform rearward of said protective ears, said iron sight assembly being positioned at a height that enables use of said iron sight assembly while viewing a target through an optical sight mounted on the upper surface of the sight mount.

4. The sight mount defined in claim 3, wherein said rear sight platform includes a vertical bore and an intersecting transverse rectangular bore, and wherein said iron sight assembly includes a vertical threaded shaft and an elevation adjustment knob which are positioned respectively in said bore and said transverse bore.

5. The sight mount defined in claim 4, wherein said base further includes a concavely curved protective ramp which is integrally formed between said protective ears and which extends upwardly from the rearmost one of said plurality of transverse slots.

* * * * *